United States Patent [19]

Herubel

[11] 4,070,732

[45] Jan. 31, 1978

[54] TEXTILE FIBRE CONTROL SYSTEM IN A DRAWING DEVICE

[75] Inventor: Jean Frédéric Herubel, Guebwiller, France

[73] Assignee: Schlumberger & Cie, Guebwiller, France

[21] Appl. No.: 753,010

[22] Filed: Dec. 21, 1976

Related U.S. Application Data

[63] Continuation of Ser. No. 592,471, July 2, 1975, abandoned.

[30] Foreign Application Priority Data

July 16, 1974 France ..... 74 24653

[51] Int. Cl.[2] ..... D01H 5/70; D01H 5/86

[52] U.S. Cl. ..... 19/236; 19/248; 19/249; 19/129 R

[58] Field of Search ..... 19/236, 244–257, 19/129 R, 127; 15/250.36, 202

[56] References Cited

U.S. PATENT DOCUMENTS

| | | | |
|---|---|---|---|
| 1,694,245 | 12/1928 | Baker et al. | 15/250.36 X |
| 3,072,945 | 1/1963 | Peterson | 15/202 X |
| 3,636,591 | 1/1972 | Herubel | 19/236 |
| 3,694,860 | 10/1972 | Herubel | 19/236 |
| 3,881,212 | 5/1975 | Regler | 15/250.36 X |

FOREIGN PATENT DOCUMENTS

| | | | |
|---|---|---|---|
| 11,173 | 5/1969 | Japan | 19/129 R |

*Primary Examiner*—Dorsey Newton
*Attorney, Agent, or Firm*—Toren, McGeady and Stanger

[57] ABSTRACT

The control system is constituted by a succession of elongate parallel control elements, made of elastomer, which extend in directions transverse to the direction of the path of the fibres to be controlled and which each have a work face and an opposite face provided with at least one longitudinal fixing rib engaged in a longitudinal slit of a tubular support part and terminated by a retention head in the said tubular support part, the drawing device including means for guiding, driving and orientating all the aforesaid tubular support parts, to ensure the displacement of the said control elements for the fibres while abutting against the other control system of the drawing device.

8 Claims, 9 Drawing Figures

TEXTILE FIBRE CONTROL SYSTEM IN A DRAWING DEVICE

This is a continuation of application Ser. No. 592,471 filed July 2, 1975, now abandoned.

This invention relates to a device for drawing, parallelising and/or cleaning textile fibres, used in the preparation for spinning, for spinning, or in other treatment of textile fibres. More particularly, the invention relates to fibre control system in such devices.

In general, such fibre control systems usually comprise a lower apron which serves as a support for a ribbon of the fibres under treatment and an upper control assembly which may be constituted by an apron, or by floating rollers or cylinders, or by other suitable means.

The aprons hitherto used are generally each in the form of a thin endless band of a width equal to that of the drawing device acting on the fibres, said band being made of a suitable flexible and elastic material and being driven at the speed of the material being worked. However, these aprons have a number of drawbacks.

in fact, for the thin band to be entrained properly, it must be subjected to considerable tension which results in the generation of heat and, accordingly, causes deterioration of the band, uneconomical consumption of energy and deformation of the necessary driving and guide for the band which detracts from the efficient operation of the device.

In addition fatigue and wear of the elastomer or other material of which the bands are made are the cause of : the bands being expensive and costly to replace; poor control of the fibres and consequential irregularity in the resultant product; slippage of the bands, which is very serious both from the textile point of view and from the mechanical point of view; and lateral deviation of the bands, especially when they are reinforced, which causes serious trouble and imposes the need for a guide or restraint to ensure correct movement of the band, which guide or restraint is onerous and trouble some and contributes to rapid wear of the bands.

The object of the invention is to provide a textile fibre control system which does not have the above-discussed disadvantages of the conventional aprons.

To this end, in accordance with the invention, the control system is constituted by a succession of elongate parallel control elements, made of elastomer, which extend in directions transverse to the direction of the path of the fibres to be controlled and which each have a work face and an opposite face provided with at least one longitudinal fixing rib engaged in a longitudinal slit of a tubular support part and terminated by a retention head in the said tubular support part, the drawing device including means for guiding, driving and orientating all the aforesaid tubular support parts, which may be of any suitable conventional type, to ensure the displacement of the said control elements for the fibres whilst abutting against the other control system of the drawing device.

Thus, the control elements of the system in question constitute a chain of which one part has a plain or smooth surface which supports the material pressed against the other system. This structure has numerous advantages.

By virtue of the special design of the mobile control system, bands are no longer necessary, which makes the assembly much more economical than hitherto and eliminates the numerous problems involved where bands are provided.

Since all of the control elements are entrained in a positive manner, all of the members turn and function freely and without constraint, which gives significant reduction in the consumption of energy compared with that necessary when drawing with the use of aprons. There is no longer any deformation of driving and guiding rollers, which contributes to the efficient functioning of the device, nor is there any slippage which, is advantageous for ensuring the quality of the resultant product.

Since the phenomena of apron fatigue and wear are obviated, there is no longer any apron bands to be changed, which represents an economy of labour and material; in addition, the control of the fibres is improved, so that the resultant product is of better quality and more regular.

Elimination of the aprons has the effect, of course, of obviating the phenomena of lateral slipping of reinforced aprons which avoids the trouble habitually resulting therefrom.

Since the operative elements are supported by rigid tubular parts, there is no longer any need for a guide or restraint, which minimises the cost price of the assembly and provides good accessibility to the control elements.

In a particular embodiment of the invention, each control element extends, in the direction of its displacement, only over the zone of a single respective one of said tubular support parts, and comprises only a single fixing rib engaged in the longitudinal slit of the said tubular support part. In other embodiments, each control elements extends, in the direction of its displacement, over a zone corresponding to the space occupied by several successive tubular parts and is provided, at each of its two ends, considered in the direction of its displacement, with a fixing rib engaged in the longitudinal slit of a corresponding tubular support part. In the extreme case, the control elements follow one another and form an apron in a single part with a continuous outer surface, of which the two adjacent ends are each provided with a fixing rib engaged in the longitudinal slit of a corresponding tubular support part.

The invention will be described further, by way of example, with reference to the accompanying drawings which illustrate various embodiments of the control systems in accordance with the invention, in a drawing device.

Figure 1:
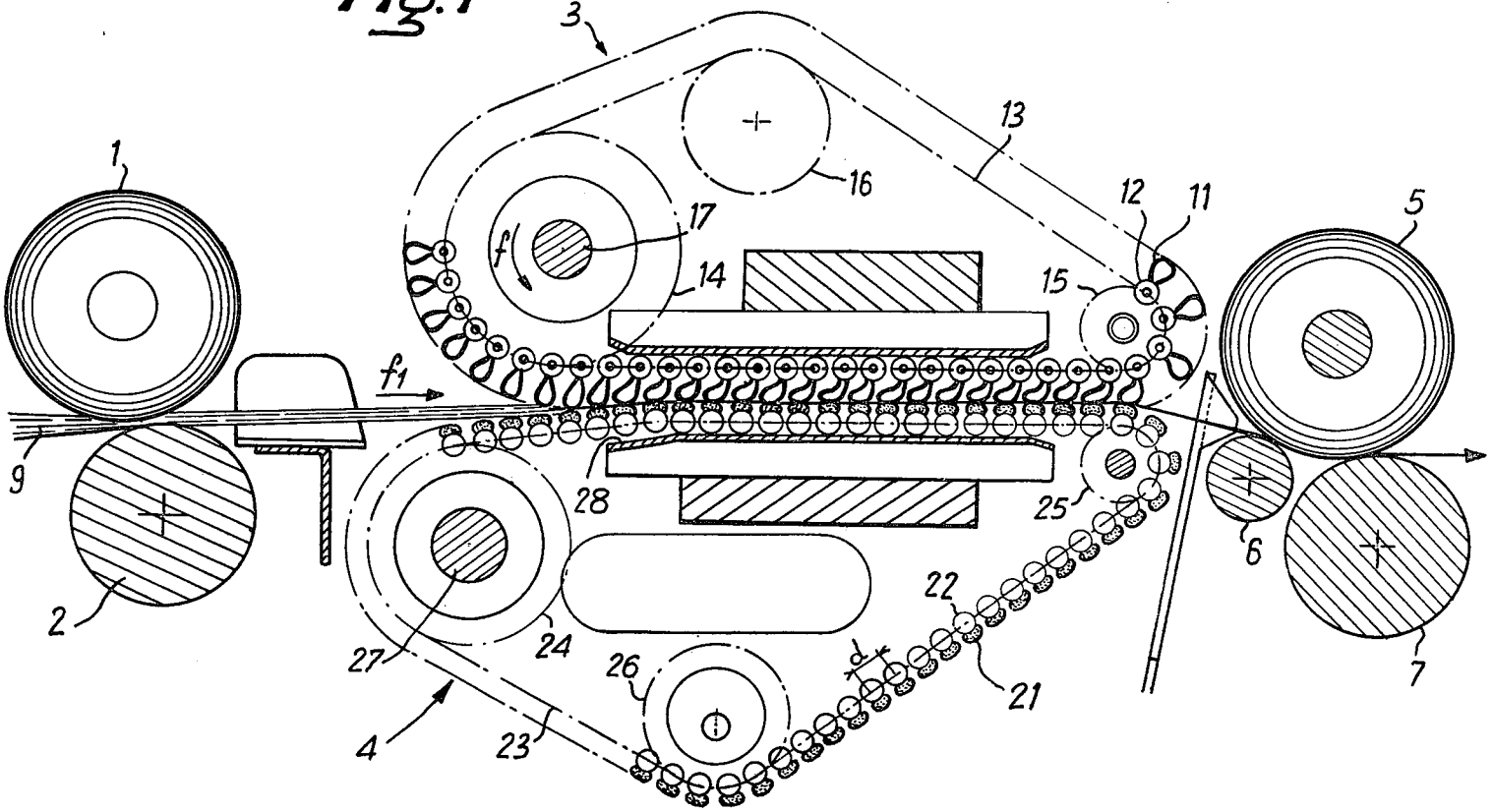
FIG. 1 is a diagrammatic part-sectional elevation illustrating the drawing device equiped with a lower control system in accordance with present invention.

The drawing device illustrated in FIG. 1 comprises essentially a pair of feed rollers 1, 2, an upper assembly and a lower assembly for control of the fibres and indicated generally respectively by the numerals 3 and 4, and an upper drawing roller 5 which cooperates with two lower rollers 6, 7 in conventional manner.

In the example shown, the upper assembly 3 for controlling and drawing the fibres is of the type described in the specification of our French Pat. No. 71. 23 620 and is constituted of flexible work elements 11 fixed on tubular elements 12 which are each supported, by their two ends, by chains 13 (indicated schematically in the drawing by dot-dash lines) passing around chain wheels 14, 15 and 16 of which one (for example the chain wheel 14) is carried by a shaft 17 driven to rotate in the direction of the arrow *f* which corresponds to the direction, indicated by arrow *f* 1, of advance of a roving 9 of fibres to be worked. The lower control assembly 4 for the fibres is of a special structure which is the subject of the present invention. It is made up of a series of elongate parallel control elements 21 each made of an elastomer and each supported by a respective tubular part 22 which itself is supported, by its two ends by respective chains (designated by the numeral 23 and indicated schematically by chain-dotted lines) which extend around chain wheels 24, 25 and 26. In the vicinity of the upper control system 3 for the fibres, the tubular support parts 22 pass over a fixed guide 28 so that the control elements 21 of the lower system press the roving 9 of fibres to be controlled or drawn against the flexible control elements 11 of the upper system 3. For assuring accurate cooperation of the control elements 11, 21 of the upper system and of the lower system, the shaft 17 and 27 which bear the chain wheels 14 and 24 respectively for driving the chains of the said elements are suitably synchronised and, to this end, for example may be coupled to a common driving shaft.

Figure 2:
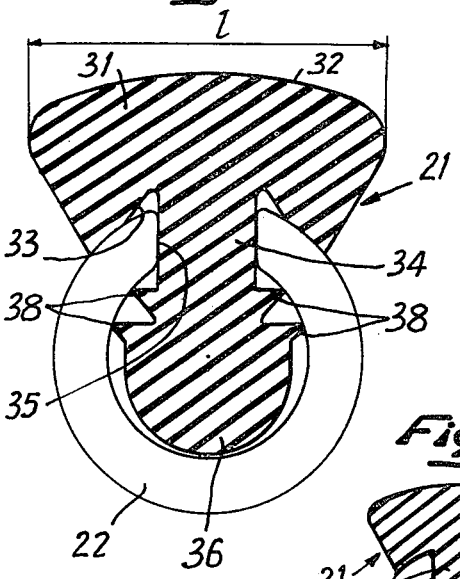
FIG. 2 is an enlarged cross-section illustrating the form of one of the control elements of the lower control system of the device of FIG. 1.

In FIG. 2 there is shown, to an enlarged scale, one embodiment of the fibre control elements 21 of the lower system 4. This element is constituted by a bar or strip 31, made of elastomer, which has a working face 32 and an opposite face 33 provided with a longitudinal fixing rib 34 which is engaged in a corresponding longitudinal slit 35 in the respective tubular support part 22 and which is terminated by a retaining head or bead 36 for retaining the control element 21 on the said tubular part 22. The width *l* of the strip 31 is substantially equal to the pitch spacing *d*. (FIG. 1) between the adjacent tubular support parts 22, so that the work faces 32 of the elements 21 in the fibre control zone above the fixed guide 28, together form a substantially continuous surface.

In this example, the work surface 32 of each of the elements 21 is slightly convex in the transverse direction of the strip 31 and the retaining head or bead 36 has a solid section with outwardly protruding tapered ribs 38 of which the tips bear against the internal cylindrical surface of the tubular support part 22.

The tubular supports 22 are each fixed, by their two ends, on the supporting and driving chains 23, for example in the same way as the tubular supports 12 of the flexible work elements 11 of the upper control system 3. As a result, the control elements 21 for the fibres of the lower system are perfectly supported and always directed towards the exterior of the assembly of the sleeve or apron formed thereby; one is thus certain that they bear appropriately against the flexible control elements 11 of the upper system.

Figure 3:
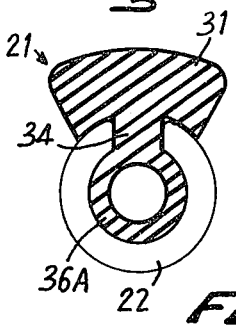
FIGS. 3, 4, 5, 6 and 7 are all views similar to FIG. 2, but to a smaller scale than the latter, illustrating respective alternative forms for the control elements.
Figure 4:
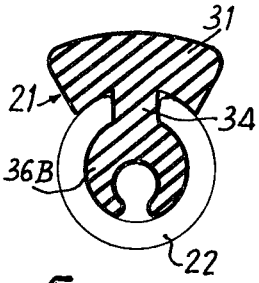
Figure 5:
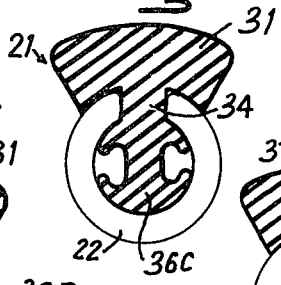
Figure 6:
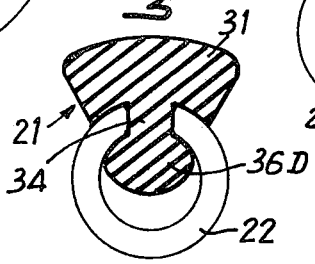
Figure 7:
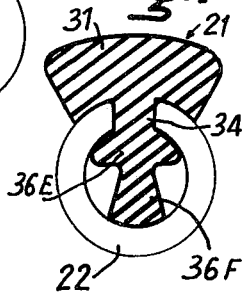

Possible variations of shape of the retaining heads of the control elements 21 of the lower fibre control system 4 are shown, in FIG. 3, with a section in the form of a circular crown or tube 36A, in FIG. 4 with a section 36B substantially in the form of a "C"; in FIG. 5 with a section 36C in the form of a double "C"; in FIG. 6 with a section 36D which is substantially mushroom shaped; and finally, in FIG. 7, with a section resembling a mushroom 36E surmounted by an extension 36F of which the free end bears in the bottom of the hollow of the tubular support element 22.

Instead of being convex in the transverse direction as shown in FIG. 2, the working face 32 of each of the control elements 21 could be of any other suitable configuration, for example, flat, concave, or even having roughnesses, nicks, notches, undulations, or depressions.

To assemble each of the control elements 21 into its respective tubular support 22, it is only necessary to insert it endwise by way of one of the ends of the said support.

Figure 8:
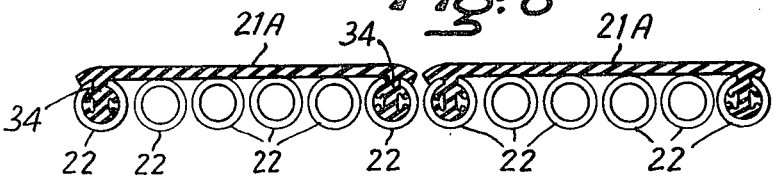
FIG. 8 is a diagrammatic fragmentary section elevation showing part of another embodiment of the lower control system of the device of FIG. 1.

In the embodiment of FIG. 1, each control element 21 is carried by a respective tubular support 22 and extends, in the direction of its displacement, only over the zone of its said support, whereas in FIG. 8 there is shown another embodiment in which each control element 21A extends, in the direction of its displacement, over a larger zone corresponding, for example, to six tubular support elements 22 and it is provided only at each of its two ends, considered in the direction of its displacement, with a rib 34 engaged in the corresponding tubular support 22. The intermediate portions of the control element 21A therefore rest freely on the corresponding intermediate tubular supports.

Figure 9:
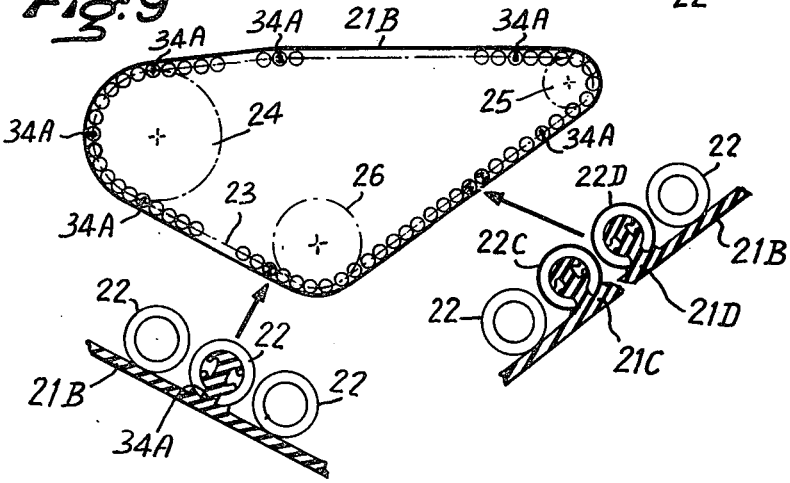
FIG. 9 is a diagrammatic elevation accompanied by two enlarged sectional details, illustrating another embodiment in which the control elements together form a slit apron, as a unitary component.

In FIG. 9 there has been shown another variation in which there is, in fact, only a single control element 21B, which forms a single flexible sleeve or apron with a gap and of which the two ends only 21C, 21D have respective fixing rib engaged in the corresponding tubular support elements 22C and 22D. Some intermediate fixing ribs may however be provided, from place to place, on the internal surface of the sleeve or apron, and be engaged in corresponding tubular supports as indicated at 34A.

Of course, the invention is not restricted to the embodiments described and illustrated and modifications may be made thereto without departing from the scope of the invention as defined by the following claims.

What I claim is:

1. A textile fibre drawing device comprising a first fibre control system including a plurality of first elongate parallel control elements adapted to be progressed in a succession along a working path, said first control elements extending transversely to the direction of movement along said working path, and a second fibre control system including a plurality of second elongate parallel control elements made of elastomer and each extending transversely to said direction of movement and having a working face and a retaining portion opposed to said working face, a respective tubular support element corresponding with each said retaining portion and having therein a respective longitudinal slit into which said retaining portion projects, means for driving, guiding and orientating said second control elements to move along said working path whilst pressed against said first control elements of said first control system, feed roller means and drawing roller means to feed and draw, respectively, textile fibres to and from operating engagement between said first and second control elements, characterized in that each said retaining portion comprises a longitudinal fixing rib engaged in said slit and terminating in a retention head accommodated within the respective support element, each said second control element being of a width, measured in the direction of its movement along said path, corresponding to the space occupied by at least two of said tubular support elements, and being provided, at each of its ends, considered in the said direction, with a respective said fixing rib engaged in the said longitudinal slits in corresponding ones of said tubular support elements.

2. A textile fibre drawing device according to claim 1 wherein said spaces over which each said second control element extends corresponds to at least three of said tubular support elements, and the portion of each said second control element between its said fixing ribs bears directly against intermediate ones of said tubular support elements.

3. A textile fibre drawing device according to claim 1 wherein the section of each said retention head is solid.

4. A textile fibre drawing device according to claim 1 wherein each said retention head has at least one longitudinal groove in its external surface.

5. A textile fibre drawing device according to claim 1 wherein each said fixing rib and its retention head taken together are formed with a cross sectional configuration having a mushroom shape.

6. A textile fibre drawing device according to claim 1 wherein each said retention head is of a tubular form.

7. A textile fibre drawing device according to claim 1 wherein said second control elements are structured to form a single integral piece having a pair of ends and defining said working face as a single continuous apron extending between said ends, and wherein a fixing rib engaged in a respective slit of a corresponding tubular support element is provided at least at each of said ends.

8. A textile fibre drawing device according to claim 7 wherein said apron is provided with additional fixing ribs intermediate said ends each engaged in respective slits of corresponding ones of said tubular support elements.

* * * * *